US010724156B2

(12) United States Patent
Brandl et al.

(10) Patent No.: US 10,724,156 B2
(45) Date of Patent: Jul. 28, 2020

(54) SPINNING-MILL MACHINE

(71) Applicant: Maschinenfabrik Rieter AG, Winterthur (CH)

(72) Inventors: Sebastian Brandl, Boehmfeld (DE); Adalbert Stephan, Beilngries/Paulushofen (DE); Harald Widner, Ingolstadt (DE); Martin Zipperer, Beilngries (DE); Helmut Haunschild, Dietfurt (DE); Christian Kettner, Koesching (DE); Alexander Holzheimer, Ingolstadt (DE)

(73) Assignee: MASCHINNENFABRIK RIETER AG, Winterthur (CH)

( * ) Notice: Subject to any disclaimer, the term of this patent is extended or adjusted under 35 U.S.C. 154(b) by 163 days.

(21) Appl. No.: 15/915,273

(22) Filed: Mar. 8, 2018

(65) Prior Publication Data

US 2018/0258560 A1 Sep. 13, 2018

(30) Foreign Application Priority Data

Mar. 9, 2017 (DE) ..... 10 2017 105 034

(51) Int. Cl.
*D01H 9/18* (2006.01)
*D01H 5/70* (2006.01)
(Continued)

(52) U.S. Cl.
CPC ..... *D01H 9/18* (2013.01); *B65H 54/06* (2013.01); *B65H 67/068* (2013.01); *D01H 5/70* (2013.01); *B65H 2701/31* (2013.01)

(58) Field of Classification Search
CPC ..... D01H 9/18; D01H 9/182; D01H 9/185; D01H 5/70; B65H 54/06; B65H 54/00;
(Continued)

(56) References Cited

U.S. PATENT DOCUMENTS 3,773,191 A * 11/1973 Ishida ..... D01H 1/183 57/276
3,828,682 A * 8/1974 Klein ..... D01H 9/182 104/91
(Continued)

FOREIGN PATENT DOCUMENTS

DE 25 06 417 A1 8/1976
DE 28 16 418 A1 10/1979
(Continued)

OTHER PUBLICATIONS

German Patent Office Search Report, dated Nov. 9, 2017.
EPO Search Report, dated Jun. 14, 2018.

*Primary Examiner* — Ismael Izaguirre
(74) *Attorney, Agent, or Firm* — Dority & Manning, P.A.

(57) ABSTRACT

A spinning-mill machine and associated operational method includes a plurality of cross-winding devices arranged next to each other in a longitudinal direction along each machine side of the spinning-mill machine, wherein each cross-winding device is configured to wind yarn onto a sleeve. The cross-winding devices are arranged into a multiple number of sections along each of the machine sides. A sleeve transport device is arranged along the cross-winding devices on each machine side to supply empty sleeves to cross-winding devices. A plurality of sleeve stacks are configured to stockpile the empty sleeves. A plurality of sleeve storage devices are arranged along each machine side for distributed intermediate storage of the empty sleeves, wherein each cross-winding device is allocated with a single sleeve storage device, or the plurality of the cross-winding devices in each of the sections are allocated to a single one of the sleeve storage devices.

11 Claims, 4 Drawing Sheets

(51) Int. Cl.
*B65H 54/06* (2006.01)
*B65H 67/06* (2006.01)

(58) Field of Classification Search
CPC ..... B65H 54/02; B65H 54/08; B65H 54/22; B65H 54/26; B65H 67/068; B65H 67/02; B65H 67/04; B65H 67/0417; B65H 67/062; B65H 67/064; B65H 67/066; B65H 67/067; B65H 67/069; B65H 2701/31; B65H 2701/00; B65H 2701/50
See application file for complete search history.

(56) References Cited

U.S. PATENT DOCUMENTS

| | | | | | |
|---|---|---|---|---|---|
| 5,168,695 | A | | 12/1992 | Stahlecker | |
| 5,224,660 | A | | 7/1993 | Stahlecker | |
| 5,509,614 | A | * | 4/1996 | Nishikawa | B65H 67/06 242/474 |
| 5,515,672 | A | * | 5/1996 | Koltze | D01H 9/187 57/281 |
| 5,582,354 | A | | 12/1996 | Peters | |
| 6,056,228 | A | | 5/2000 | Resch | |
| 6,431,809 | B1 | * | 8/2002 | Teich | B65H 67/064 414/279 |
| 6,769,854 | B2 | * | 8/2004 | Wolf | B65H 67/064 242/559 |
| 2017/0342604 | A1 | | 11/2017 | Pohn et al. | |

FOREIGN PATENT DOCUMENTS

| | | | |
|---|---|---|---|
| DE | 33 40 497 | A1 | 5/1985 |
| DE | 39 08 462 | A1 | 2/1990 |
| DE | 39 39 924 | A1 | 6/1991 |
| DE | 43 28 033 | A1 | 2/1995 |
| DE | 44 18 339 | A1 | 11/1995 |
| DE | 195 12 891 | A1 | 10/1996 |
| DE | 198 19 294 | A1 | 11/1999 |
| DE | 10 2004 012 254 | A1 | 9/2005 |
| DE | 10 2008 040 320 | A1 | 1/2010 |
| EP | 0 916 614 | A2 | 5/1999 |
| GB | 2 149 434 | A | 6/1985 |
| WO | WO 2016/102456 | A1 | 6/2016 |

* cited by examiner

SPINNING-MILL MACHINE

FIELD OF THE INVENTION

The present invention relates to a spinning-mill machine with a plurality of cross-winding devices arranged next to each other and on two machine sides located in the longitudinal direction of the spinning-mill machine, each of which is provided for winding yarn onto sleeves. The cross-winding devices are collected into a multiple number of sections, with one or more sleeve stacks for the stockpiling of empty sleeves and with a sleeve transport device arranged along a cross-winding device for supplying the cross-winding devices with empty sleeves from the sleeve stack.

BACKGROUND

DE 10 2008 040 320 A1 discloses a textile machine with a sleeve storage device arranged at a front end of the textile machine, which is formed as a main storage device for the stockpiling of sleeves. With a machine-long conveyor belt, sleeves are transported to the work stations and an additional sleeve storage device, which is formed as an intermediate storage device and can be loaded via the conveyor belt through the main storage device. The intermediate storage device features a sleeve receptacle for keeping the sleeve in a ready position outside the conveyor belt. With a device for taking the sleeve into the ready position, the sleeve is removed from the conveyor belt and once again placed on the conveyor belt at the appropriate time.

Modern textile machines, such as (for example) open-end rotor spinning-mill machines or winding machines, are able to wind different yarns on bobbins at their many work stations. For the individual varying yarns, it is frequently necessary or at least helpful for the later recognition of the respective yarn if different sleeve types are provided on the textile machine. In this case, one yarn type is wound onto a specific sleeve, which is marked in a particular color.

In addition, modern textile machines are frequently very long; that is, they feature a large number of work stations. In order to increase productivity, an attempt is made to perform a bobbin change as quickly as possible. With this, the necessary sleeve must be provided without a long waiting time. With a textile machine with more than 100 m in length, it is disadvantageous if the sleeve has to be transported over the entire distance, since this takes a very long time. In DE 10 2008 040 320 A1, it is accordingly proposed that a sleeve is stored in the intermediate storage device and from there is transported to the corresponding work station when needed. This shortens the removal of the transport and thus the corresponding waiting time for the bobbin changing device. However, the disadvantage here is that different sleeve types cannot be stored on an intermediate basis, and the stored, wrong sleeve thus possibly blocks the path for a correct sleeve.

SUMMARY OF THE INVENTION

Thus, a task of the present invention is to provide a spinning-mill machine that is able to transport different sleeve types to storage devices and as needed to a corresponding work station with the shortest possible transport time. Additional objects and advantages of the invention will be set forth in part in the following description, or may be obvious from the description, or may be learned through practice of the invention.

The tasks are achieved with a spinning-mill machine with the characteristics described and claimed herein.

The spinning-mill machine in accordance with the invention features a multiple number of cross-winding devices arranged next to each other and on two machine sides located in the longitudinal direction of the spinning-mill machine, each of which is provided for winding yarn onto sleeves. The cross-winding devices are collected into a multiple number of sections. In each section, for example, 8 or 10 cross-winding devices are arranged on each machine side. A sleeve transport device arranged along the cross-winding devices serves to supply the cross-winding devices with empty sleeves from a sleeve stack.

The spinning-mill machine features a multiple number of sleeve stacks, which serve to stockpile empty sleeves. In accordance with the invention, a multiple number of sleeve storage devices for the distributed intermediate storage of sleeves are arranged on each machine side. Alternatively, each cross-winding device is allocated with a single sleeve storage device for at least one sleeve and/or a multiple number of cross-winding devices are allocated with a multiple sleeve storage device for a multiple number of sleeves. Thus, in particular, at least individual, preferably all, sections are allocated with a multiple sleeve storage device.

Due to the distributed intermediate storage device of sleeves, a multiple number of individual locations of the sleeves is provided, by which a multiple number of different sleeve types can be stored on an intermediate basis. If different sleeve types are needed, they can be requested and transported within a very short period of time due to the distributed storage along the machine side of the textile machine. Thus, the supply of the correct sleeve at the corresponding cross-winding device or work station, as the case may be, may take place within a very short period of time. The sleeves are transported by the sleeve transport device to the sleeve storage device, in some cases long before they are actually needed at a work station. By means of appropriate, known devices such as grippers, the sleeves are removed from the sleeve transport device and stored in the sleeve storage device. If necessary, they are removed from the sleeve storage device with a suitable device, for example by means of a gripper, which is arranged on the sleeve storage device, placed back on the sleeve transport device and brought to the work station at which they are needed. If a single sleeve storage device is provided on each cross-winding device, the corresponding sleeve is removed from the allocated cross-winding device directly from the single sleeve storage device, provided that such cross-winding device requires the corresponding type of sleeve. Otherwise, the sleeve is removed from the single sleeve storage device, as described above, placed on the sleeve transport device and brought to the winding unit at which it is currently needed. If a multiple sleeve storage device is provided, different sleeves are stored on an intermediate basis therein. These can either be of the same type, such that, with a multiple number of multiple sleeve storage devices distributed along the machine, the appropriate sleeve is available. The sleeves can be stored therein in a sorted manner, and placed on the transport device if the corresponding sleeve is needed. It is also possible that, in the multiple sleeve storage device, a multiple number of different sleeve types are stored; these are selected with a corresponding need and placed on the sleeve transport device.

It is particularly advantageous if each sleeve stack is allocated exclusively to a predetermined machine side for the stockpiling of empty sleeves for such machine side. Thus, the design of the sleeve transport device is considerably simplified, since the sleeve does not have to be brought to the other machine side. In addition, a multiple number of sleeve stacks can be provided, which stockpile the different sleeve types in a sorted or chaotic manner and can transport the respective sleeve type in the intermediate storage device with a corresponding selection system. Of course, it is also possible that one sleeve transport device serves both machine sides.

Advantageously, the sleeve storage device is provided with a receiving and/or dispensing device to be able to receive or dispense the sleeves from or to the sleeve transport device. Thus, the sleeve transport device can be kept free for the transport of other sleeves and is not blocked by the sleeves stored on an intermediate basis in the sleeve storage devices.

In an advantageous design of the invention, the sleeve transport device is a conveyor belt arranged in a stationary manner along the cross-winding devices and/or a maintenance device that can be moved along the cross-winding devices. In particular, the conveyor belt is a cost-effective sleeve transport device. In particular, the use of a conveyor belt enables a rapid and reliable feeding of the sleeves to the intermediate storage device or the requesting work station. In other designs, it is also possible that a movable maintenance device removes the sleeves from the sleeve stack and takes them to the corresponding sleeve storage device in order to store them there on an intermediate basis. This is particularly advantageous if the maintenance device has periods of time in which no maintenance is required. Such maintenance-free times can be used to fill the sleeve storage devices.

If the sleeve transport device, in particular the conveyor belt, can be reversibly driven, sleeves can be transported from an intermediate storage device or from the sleeve stack in both directions. This further increases the flexibility of the system. The request of a corresponding sleeve can accordingly take place in such a manner that it is sent from the sleeve stack that is closest to the requesting work station.

Advantageously, the multiple number of sleeve stacks are aligned in a manner parallel to the machine side. This facilitates the handling and loading of the sleeves from the sleeve stack. In addition, the installation space of the machine is reduced and the allocation of the single sleeve stacks to the individual machine sides is facilitated. Overall, this increases the capacity of the sleeve stacks, since they cling to the machine along the machine side, and thus a multiple number of sleeve stacks can be made available.

If a multiple number of sleeve stacks are arranged on each machine side, the capacity of the sleeves provided is thereby markedly increased compared to a front-side arrangement of the sleeve stacks. Thus, significantly more sleeves can be stacked. Thus, the mostly manually performed equipping of the sleeve stacks with sleeves can be carried out with a high degree of efficiency, since, given the high capacity, a re-equipping process must take place only rarely.

It is particularly advantageous if a multiple number of sleeve stacks are arranged next to each other on each machine side. Thus, the filling of the sleeve stacks is possible with a high degree of ease.

If the multiple number of sleeve stacks are arranged in the area of supply units of the spinning-mill machine, in particular on a drive frame, intermediate frame or end frame of the respective machine side, the sleeve stacks can be distributed along the machine and thus, as a whole, bring about a shortening of the feeding length on the spinning-mill machine.

If the sleeve stack features a transfer station for transferring a sleeve to the sleeve transport device, the sleeve transport device can very easily take over sleeves from the sleeve stack and convey them to the corresponding sleeve storage devices or work stations, as the case may be.

A method in accordance with the invention is used to transport sleeves on a spinning-mill machine, as was described above, which features a multiple number of cross-winding devices arranged next to each other and on two machine sides located in the longitudinal direction of the spinning-mill machine, on each of which yarn is wound onto sleeves. The cross-winding devices are collected into a multiple number of sections. At the spinning-mill machine, empty sleeves are stockpiled in a multiple number of sleeve stacks. With a sleeve transport device arranged along the cross-winding devices, the cross-winding devices are supplied with empty sleeves from the sleeve stack. Various sleeve types are stored in the multiple number of sleeve stacks, and a multiple number of sleeve storage devices, in which sleeves are distributed and stored on an intermediate basis, are arranged on each machine side. At each cross-winding device, at least one sleeve in a single sleeve storage device, and/or for a multiple number of cross-winding devices, a multiple number of sleeves in a multiple sleeve storage device, are stored on an intermediate basis in at least individual (in particular), preferably all, sections. In accordance with the invention, a suitable sleeve type from the sleeve storage device is fed to the respective cross-winding devices that require the corresponding sleeve type. In this case, different sleeve types are stored in the one or more sleeve stacks, since different yarn types are wound on the spinning-mill machine. Due to the distributed storage of the sleeves or the different sleeve types along the machine side, the feeding of the individual sleeves to the work station or cross-winding device that need them is possible with a high degree of speed.

The various sleeve types can be stored in a sorted or chaotic manner. This is possible both in the sleeve stacks and in the single sleeve storage devices. A corresponding control device registers or recognizes the respective sleeve type available in the respective sleeve stack or sleeve storage device, and is able to supply the cross-winding device with the corresponding sleeve type as required.

The required sleeve type can accordingly be delivered from the nearest sleeve storage device.

The device and the method in accordance with the invention are formed in accordance with the preceding description, whereas the specified characteristics can be present individually or in any combination.

BRIEF DESCRIPTION OF THE DRAWINGS

Further advantages of the invention are described in the following embodiments. The following is shown.

DETAILED DESCRIPTION

Figure 1:
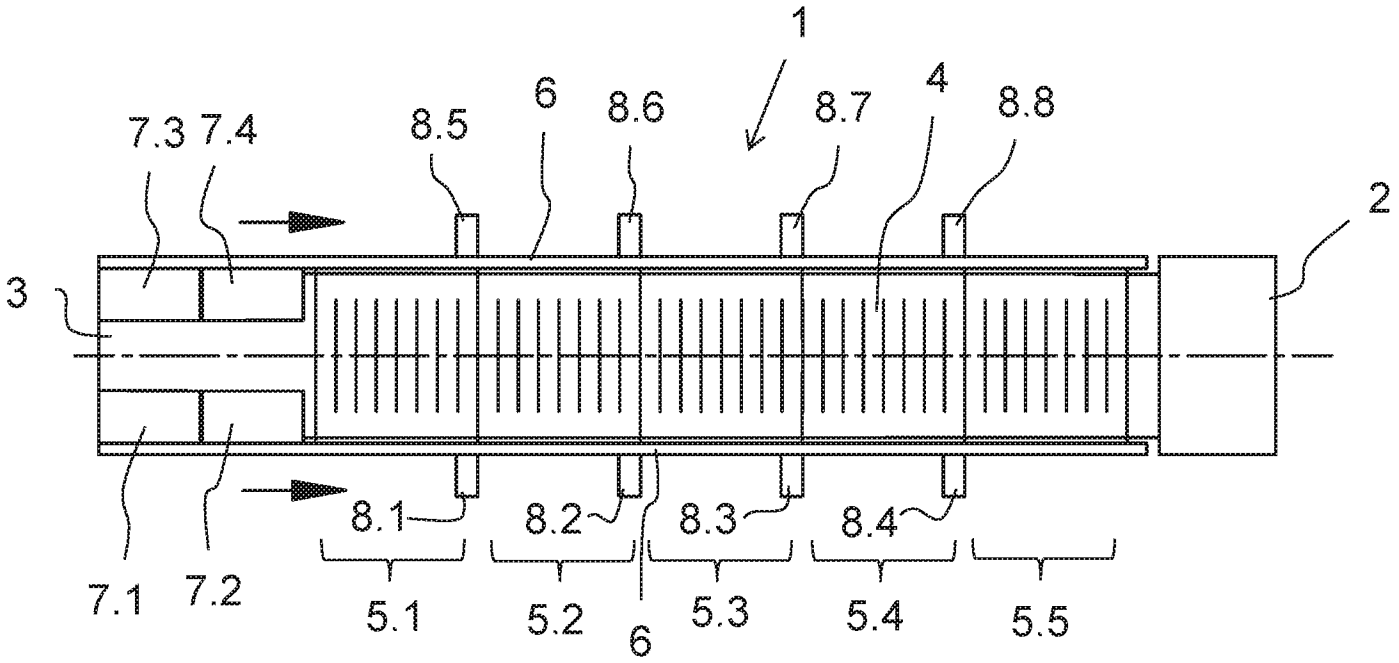
FIG. 1 is a spinning-mill machine with a multiple number of sleeve stacks and multiple sleeve storage devices.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

With the following description of the illustrated alternative embodiments, the same reference signs are used for characteristics that are identical and/or at least comparable in their arrangement and/or mode of action compared to the other illustrated embodiments. To the extent that such are not described once again in detail, their designs and/or modes of action correspond to the designs and modes of action of the characteristics described above.

FIG. 1 shows a top view of a spinning-mill machine 1 shown in outline, for example an open-end rotor spinning-mill machine or a winding machine. The spinning-mill machine 1 features a drive frame 2 and an end frame 3, which are respectively arranged at the end of the spinning-mill machine 1. The spinning-mill machine 1 features two machine sides in the longitudinal direction, on which a multiple number of cross-winding devices 4 are arranged between the drive frame 2 and the end frame 3. For reasons of clarity, only one of the cross-winding devices 4 is provided with a reference sign. The multiple number of cross-winding devices 4 is collected into sections 5.1 to 5.5. In each section 5.1 to 5.5, eight cross-winding devices 4 are arranged on each machine side. In each of the cross-winding devices 4, a holder (not shown here) for a sleeve is provided, onto which a yarn is wound cross-wise. Depending on the yarn type, a different sleeve type is required. This is necessary or at least helpful in order to, later on, be able to more easily identify the yarn type that is located on the sleeve, if the bobbin is no longer located on the cross-winding unit 4.

Along the multiple number of cross-winding devices 4, a sleeve transport device 6 is arranged on each side of the spinning-mill machine 1. In the present embodiment, the sleeve transport device 6 is formed as a conveyor belt, on which sleeves are placed and transported to a predetermined destination. The sleeves are located in a large number in a multiple number of sleeve stacks 7.1 to 7.4. In the embodiment of FIG. 1, two sleeve stacks 7.1 and 7.2 or 7.3 and 7.4, as the case may be, are arranged in the end frame 3 on each machine side. The two sleeve stacks 7.1 and 7.2 or 7.3 and 7.4, as the case may be, are arranged one behind the other in the longitudinal direction of the machine. As a result, they cling closely to the spinning-mill machine 1, and thus require little installation space. Due to the division on each machine side into two sleeve stacks 7.1 and 7.2 or 7.3 and 7.4, as the case may be, the system is even more flexible. A sorted stacking of the sleeves is possible, such that, by such four existing sleeve stacks 7.1 to 7.4 (for example), many different sleeve types can be stacked. In terms of control technology, the transmission of the sleeves to the corresponding cross-winding devices can take place very easily, since the sleeve type in which the sleeve stacks 7.1 to 7.4 is located is known.

In the present embodiment, the sleeve transport device 6 has a single direction of transport in the direction of the arrow. This means that the sleeves are removed from the sleeve stacks 7.1 to 7.4, transferred to the sleeve transport device 6 and moved by it in the direction of the arrow. Multiple sleeve storage devices 8.1 to 8.8 are arranged along the sleeve transport device 6. In each case, a multiple number of sleeves is stored in the multiple sleeve storage devices 8.1 to 8.8. Such sleeves can be stored on an intermediate basis for each multiple sleeve storage device 8.1 to 8.8 either in a sorted manner in each multiple sleeve storage device 8.1 to 8.8. However, it is also possible that they are stored in a chaotic basis; that is, a multiple number of sleeve types are stored in a multiple sleeve storage device 8.1 to 8.8. Accordingly, the sleeves are transported from the sleeve stacks 7.1 to 7.4 into one of the multiple sleeve storage devices 8.1 to 8.8, stored on an intermediate basis therein and, if the need for one of the cross-winding devices 4 has been announced, placed from the multiple sleeve storage device 8.1 to 8.8 once again on the sleeve transport device 6 and transported to the corresponding cross-winding device 4. There, the sleeve is removed from the cross-winding device 4 and spooled with yarn. Depending on the yarn type on the corresponding cross-winding device 4, a sleeve type is requested. The control device of the sleeve transport device 6 is designed in such a manner that the sleeve is placed on the sleeve transport device 6 from the multiple sleeve storage device 8 in which the requested sleeve type is located.

In the illustrated embodiment, four multiple sleeve storage devices 8.1 to 8.4 or 8.5 to 8.8, as the case may be, are shown on each machine side. The four sections 5.2 to 5.5 are fed from the multiple sleeve storage devices 8.1 to 8.4 or 8.5 to 8.8, as the case may be, while the first section 5.1 is supplied directly from the sleeve stacks 7.1, 7.2 or 7.3, 7.4, as the case may be. Of course, it is also possible that an additional multiple sleeve storage device 8 is arranged directly between the sleeve stacks 7.2 or 7.4, as the case may be, and the first section 5.1, in order to supply them with sleeves from the multiple sleeve storage device 8.

Figure 2:
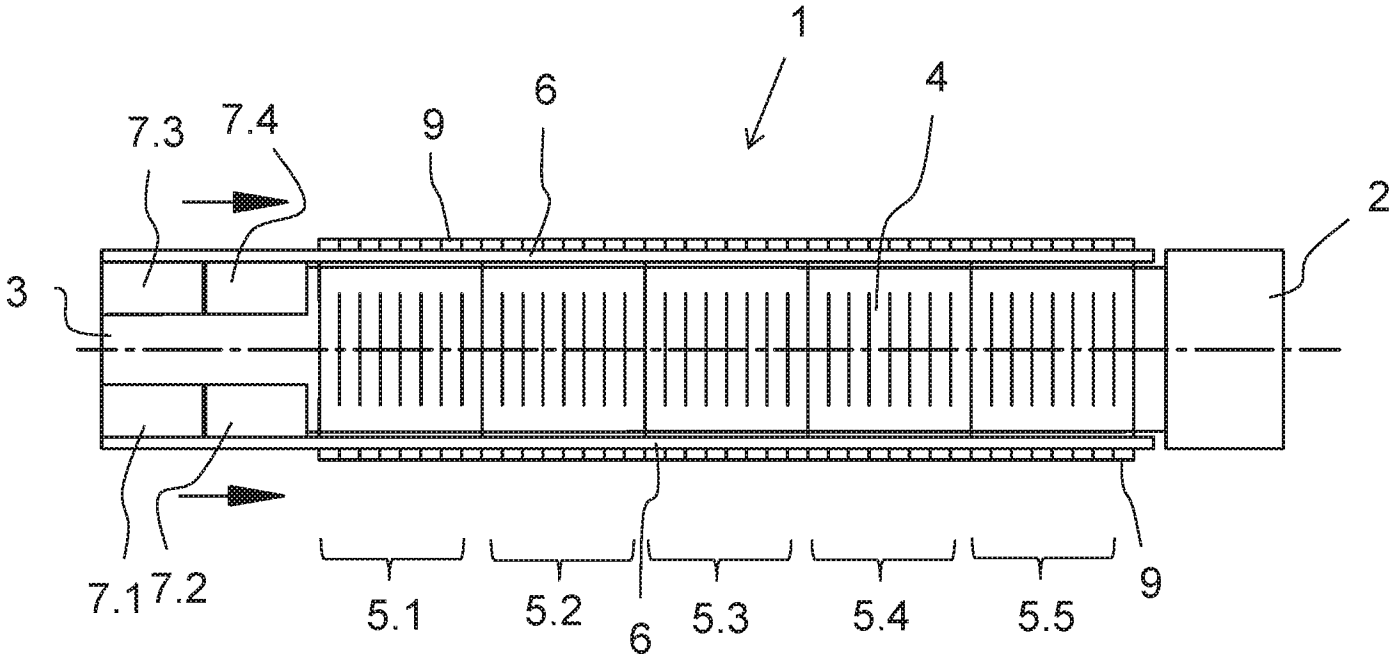
FIG. 2 is a spinning-mill machine with a multiple number of sleeve stacks and single sleeve storage devices at each cross-winding station.

The illustration of FIG. 2 also shows a spinning-mill machine 1 in a top view and in a sketched illustration. It essentially corresponds to the arrangement of the spinning-mill machine 1 of FIG. 1. In this case, a difference is that each of the cross-winding devices 4 is allocated with a single sleeve storage device 9. Ideally, the sleeve type required at the respective cross-winding device 4 is stored directly in the single sleeve storage device 9 allocated to it. Where required, it is taken directly from the single sleeve storage device 9 and delivered to the corresponding cross-winding device 4. The supply of the single sleeve storage device 9 in turn takes place through the sleeve stacks 7.1, 7.2 or 7.3, 7.4, as the case may be, arranged on the end frames 3. If the sleeve type is not stored directly in front of the corresponding cross-winding device 4 in its single sleeve storage device 9, either because the storage of the sleeves is chaotic and not sorted, or because the sleeve at the cross-winding device 4 is missing, it is also possible that the sleeve from the single sleeve storage device 9 of a different cross-winding device 4 is placed on the sleeve transport device 6 and transported from there to the corresponding, suitable cross-winding device 4 and is accepted by it. As a result, as a rule, the transport routes will be significantly shorter, and the supply of the cross-winding devices 4 with sleeves will thus proceed significantly faster than if each sleeve had to be sent from one of the sleeve stacks 7.1 to 7.4 arranged on the end side.

Figure 3:
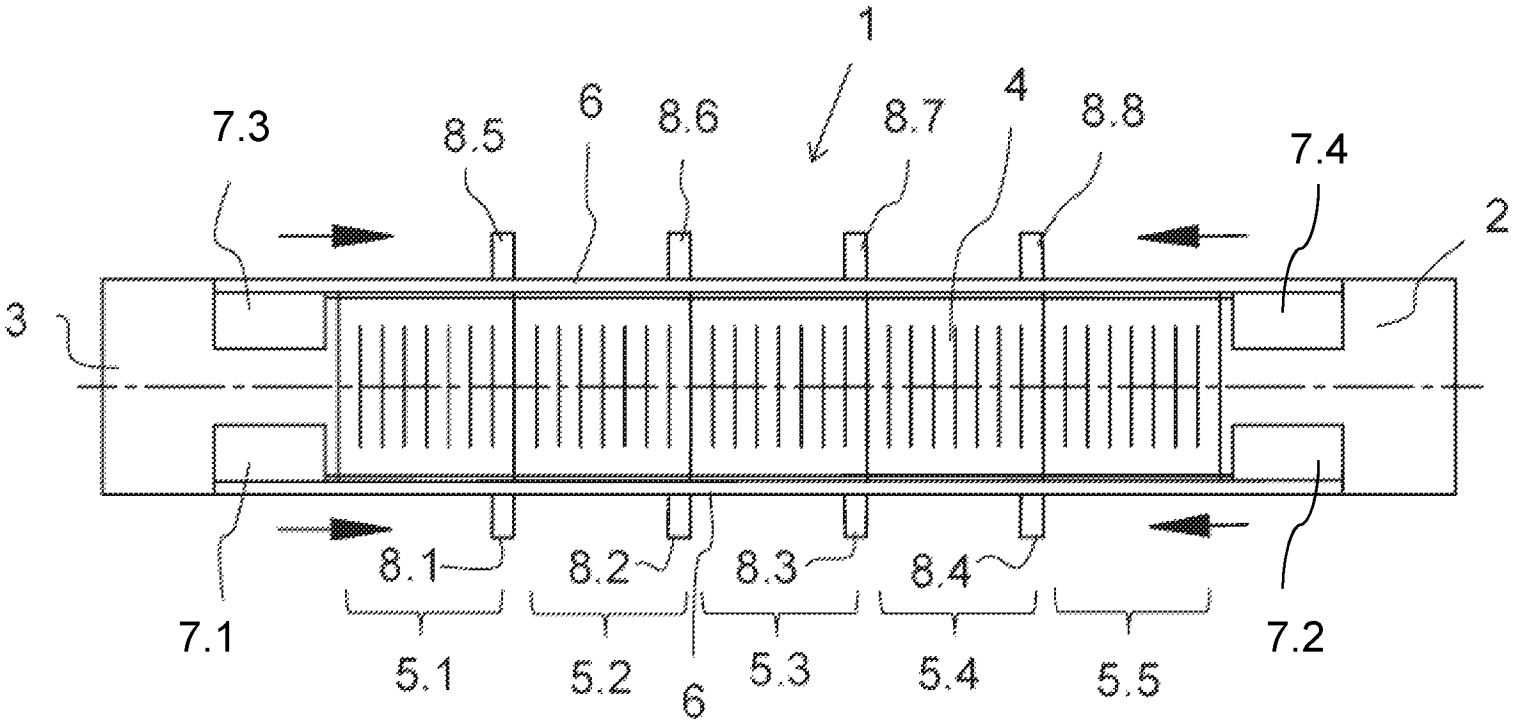
FIG. 3 is a spinning-mill machine with sleeve stacks at both ends of the spinning-mill machine and multiple sleeve storage devices.

FIG. 3 shows a spinning-mill machine 1, which is constructed with respect to the multiple sleeve storage device 8 that is similar to the spinning-mill machine 1 of FIG. 1. With the design according to FIG. 3, the arrangement of the sleeve stacks 7.1 to 7.4 is varied. Two of the sleeve stacks 7.1, 7.3 are arranged on the end frame 3 of the spinning-mill machine 1, while the other two sleeve stacks 7.2, 7.4 are arranged on the drive frame 2. The sleeve transport device 6 is allocated with one machine side for both sleeve stacks 7.1, 7.2 or 7.3, 7.4, as the case may be. Accordingly, the sleeve transport device 6, indicated by the arrows, is operable in both directions. Thus, on the one hand, a sleeve can be transported from the sleeve stack 7.1 in the direction of the sleeve stack 7.2 and, on the other hand, a sleeve can be transported from the sleeve stack 7.2 in the direction of the sleeve stack 7.1. The same applies to the opposite machine side by analogy. This arrangement can be more favorable in terms of space requirements and allows additional sleeve stacks, similar to those shown in FIG. 1 and FIG. 2, to be arranged on the spinning-mill machine 1 following the respective sleeve stack. Thus, the capacity of the stackable sleeves was even more expandable.

As in FIG. 1, multiple sleeve holders 8.1 to 8.8, in each of which a multiple number of sleeves can be stored on an intermediate basis, are arranged along the spinning-mill machine 1 of FIG. 3 at the individual sections 5.1 to 5.5. The supply of the individual cross-winding device 4 with sleeves then takes place as previously described.

Figure 4:
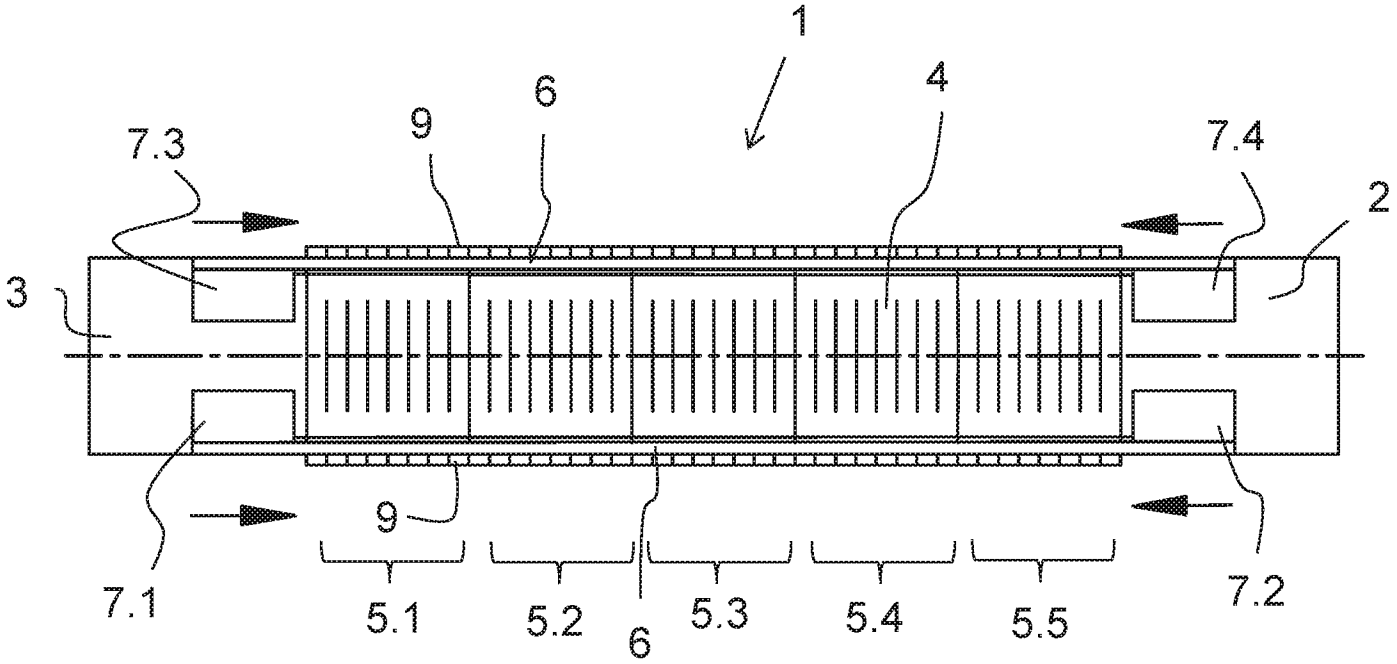
FIG. 4 is a spinning-mill machine with sleeve stacks at the ends of the spinning-mill machine and single sleeve storage devices at each cross-winding station.

FIG. 4 shows a spinning-mill machine 1 that is a combination of the spinning-mill machines 1 of FIG. 2 and FIG. 3. The sleeve stacks 7.1 and 7.4 are arranged, according to the FIG. 3, both in the drive frame 2 and in the end frame 3 of the spinning-mill machine 1. Instead of multiple sleeve storage devices 8, single sleeve storage devices 9, which are located immediately in front of each cross-winding device 4, are provided at each cross-winding device 4. The sleeve transport device 6 is in turn operable in both directions, such that the single sleeve storage device 9 can be fed from the sleeve stacks 7.1 to 7.4 located on both sides.

This invention is not limited to the illustrated and described embodiments. Variations within the scope of the claims, just as the combination of characteristics, are possible, even if they are illustrated and described in different embodiments.

LIST OF REFERENCE SIGNS

1 Spinning-mill machine
2 Drive frame
3 End frame
4 Cross-winding devices
5.1 to 5.5 Sections
6 Sleeve transport device
7.1 to 7.4 Sleeve stacks
8.1 to 8.8 Multiple sleeve storage devices
9 Single sleeve storage device

The invention claimed is:

1. A spinning-mill machine, comprising:

a plurality of cross-winding devices arranged next to each other in a longitudinal direction along each machine side of the spinning-mill machine, each cross-winding device configured to wind yarn onto a sleeve;

the cross-winding devices arranged into a multiple number of sections along each of the machine sides;

a sleeve transport device arranged along the cross-winding devices on each machine side to supply empty sleeves to cross-winding devices;

a plurality of sleeve stacks configured to stockpile different types of the empty sleeves;

a plurality of sleeve storage devices in a fixed location along each machine side for distributed intermediate storage of a plurality of the empty sleeves, wherein each cross-winding device is allocated to a single sleeve storage device, or the plurality of the cross-winding devices in each of the sections are allocated to a single one of the sleeve storage devices.

2. The spinning-mill machine according to claim 1, wherein each sleeve stack is allocated exclusively to a predetermined machine side for the stockpiling of empty sleeves for the machine side.

3. The spinning-mill machine according to claim 1, further comprising a device at each of the sleeve storage devices to receive or dispense the sleeves from or to the sleeve transport device.

4. The spinning-mill machine according to claim 1, wherein the sleeve transport device comprises one of a conveyor belt arranged along the cross-winding devices, or a maintenance device that is movable along the cross-winding devices.

5. The spinning-mill machine according to claim 1, wherein the sleeve transport device is reversible in the longitudinal direction along the cross-winding devices.

6. The spinning-mill machine according to claim 1, wherein the sleeve stacks are aligned parallel to the machine side.

7. The spinning-mill machine according to claim 6, wherein a plurality of the sleeve stacks are arranged on each machine side.

8. The spinning-mill machine according to claim 1, wherein a plurality of the sleeve stacks are arranged next to each other on each machine side.

9. The spinning-mill machine according to claim 8, wherein are arranged at one or more of a drive frame, intermediate frame, or end frame area of the machine.

10. A method for transporting sleeves on a spinning-mill machine having a plurality of cross-winding devices arranged next to each other in a longitudinal direction along each machine side of the spinning-mill machine, each cross-winding device configured to wind yarn onto a sleeve, and wherein the cross-winding devices are arranged into a multiple number of sections along each of the machine sides, and wherein a sleeve transport device is arranged along the cross-winding devices on each machine side to supply empty sleeves to cross-winding devices, the method comprising:

stockpiling empty sleeves at a plurality of sleeve stacks, wherein the empty sleeves include different sleeve types;

intermediately storing and distributing the empty sleeves from a plurality of sleeve storage devices arranged along each machine side, wherein;

at each cross-winding device, an empty sleeve is intermediately stored in a single sleeve storage device allocated to the cross-winding device, or for the cross-winding devices in each of the sections, a plurality of the empty sleeves are intermediately stored in one of the sleeve storage devices allocated to the section; and for a cross-winding device requiring an empty sleeve, transporting a suitable sleeve type from the sleeve storage device to the cross-winding device.

11. The method according to claim 10, wherein the different sleeve types are stored in a sorted or chaotic manner in the sleeve stacks or in the sleeve storage devices.

* * * * *